United States Patent [19]

Wells

[11] Patent Number: 4,919,229

[45] Date of Patent: Apr. 24, 1990

[54] STABLE WORKING PLATFORM

[76] Inventor: David E. Wells, 1617 East Badger Rd., Everson, Wash. 98247

[21] Appl. No.: 237,971

[22] Filed: Aug. 29, 1988

Related U.S. Application Data

[63] Continuation-in-part of Ser. No. 130,008, Dec. 8, 1987, abandoned.

[51] Int. Cl.[5] ..... E06C 7/46

[52] U.S. Cl. ..... 182/17; 182/107; 182/127; 182/151; 182/132

[58] Field of Search ..... 182/107, 108, 12, 17, 182/92, 116, 230, 127, 178, 151

[56] References Cited

U.S. PATENT DOCUMENTS

| | | | |
|---|---|---|---|
| 2,378,678 | 6/1945 | Anderson | 182/150 |
| 2,872,252 | 2/1959 | Konkle | 182/131 |
| 4,072,209 | 2/1978 | Bolis | 182/116 |
| 4,405,141 | 9/1983 | Jurek | 182/92 |
| 4,605,098 | 8/1986 | Leuty | 182/92 |

*Primary Examiner*—Reinaldo P. Machado

*Attorney, Agent, or Firm*—Graybeal, Jensen & Puntigam

[57] ABSTRACT

A load support platform for use in conjunction with a vehicle tire wherein a pair of outwardly flared feet 22, 24 interact with the tire such that lateral or downward forces on the platform 6 is resisted by the weight of the vehicle.

9 Claims, 3 Drawing Sheets

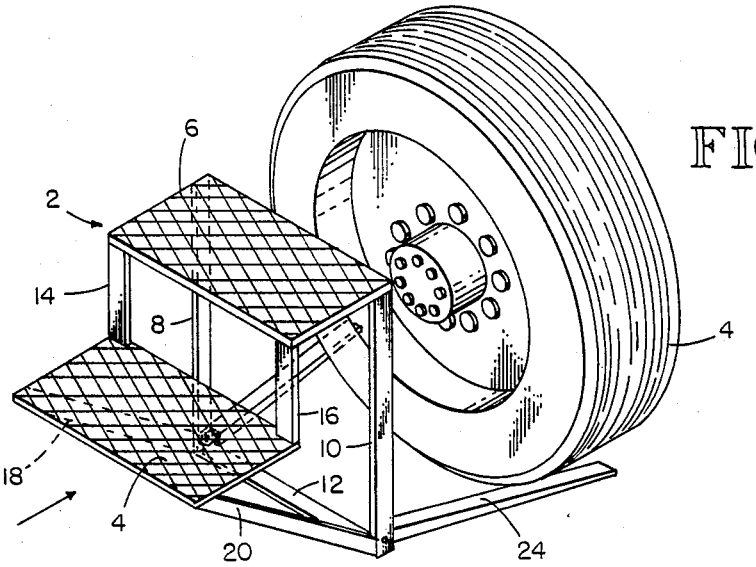
FIG. 1
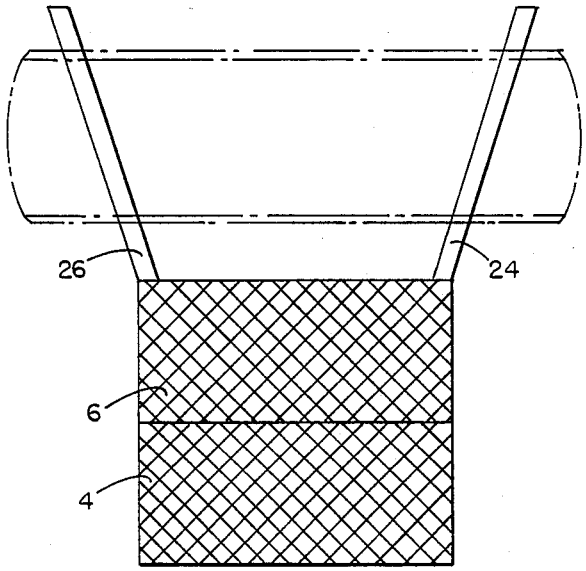
FIG. 2
FIG. 3
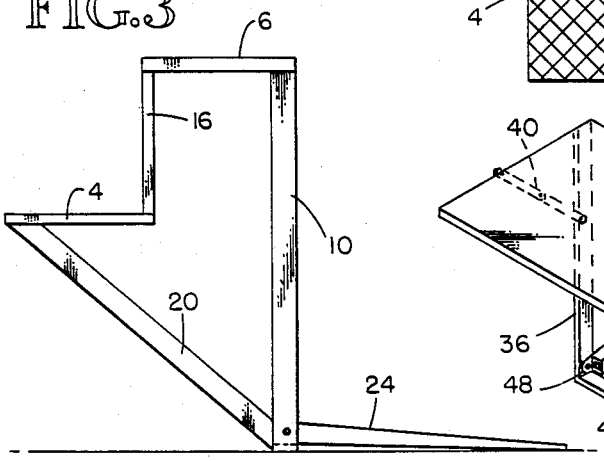
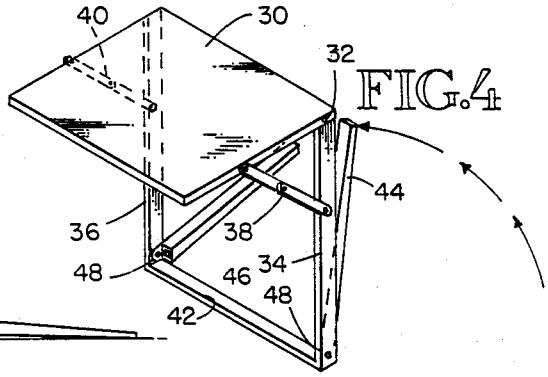
FIG. 4

STABLE WORKING PLATFORM

DESCRIPTION

This is a continuation-in-part application of Ser. No. 130,008 filed Dec. 8, 1987 and now abandoned.

TECHNICAL FIELD

This application relates to working platforms in general and in particular to a working platform for use in conjunction with a motor vehicle wherein the interaction between a pair of rearwardly extending feet and the tire of the motor vehicle create a stable working platform capable of supporting a great deal of weight and successfully resisting forces directed downwardly and sidewardly. The rearwardly extending legs simultaneously serve as a wheel chock.

BACKGROUND ART

It is well recognized that the maintenance and care of motor vehicles frequently requires that the person doing the work place the upper portion of his trunk in a position overlying the engine compartment. In a standard automobile this is generally not a problem since the vehicle is low enough that the persons feet are firmly resting upon the ground. However, when dealing with a truck or larger vehicle, the person who is doing the servicing often needs to be elevated from the ground thus requiring them to place their feet on a ladder of the like. Obviously, this elevation of the body in general destabilizes the body and further placing the feet upon a support device compounds the insecurity because any lateral movement of the trunk creates a sideward force on the support device tending to cause a tipping of the support device.

Prior art which has recognized the need for the elevation of a mechanic or the like include U.S. Pat. No. 2,378,678 granted to Anderson on June 19, 1945 which discloses a portable step having a pair of hook-like upper arms for extending over the top of a vehicle tire, an outwardly extending platform for supporting the user and a lower device for abutment against the vehicle tire.

U.S. Pat. No. 2,872,252 granted to Konkle Feb. 3, 1959 discloses a wheeled servicing stand having a telescoping upper portion for various elevations, telescoping outriggers for greater stability and the inclusion of an adjustable stem member.

U.S. Pat. No. 4,072,209 granted to Bolis on Feb. 7, 1978 discloses a mechanic stand having a cantilevered body support system allowing a mechanic to work upon a vehicle without contacting the vehicle, including a support for the mechanic's feet and a pair of rearwardly extending legs which support the mechanic's weight.

U.S. Pat. No. 4,405,141 granted to Jurek Sept. 20, 1983 which discloses a step permitting the servicing of a vehicle wherein the step is locked to the bumper of the vehicle.

U.S. Pat. No. 4,605,098 granted to Leuty Aug. 12, 1986 likewise discloses a device which is locked to the bumper to provide support to a mechanic or the like.

DISCLOSURE OF THE INVENTION

The present invention includes a simple structure for use in conjunction with a motor vehicle including at least one horizontal platform member to support an object, a downwardly extending vertical member of an appropriate height and rearwardly extending flared feet for interaction with the bottom of the vehicle tire.

Accordingly, it is an object of the present invention to provide a simple platform for use in conjunction with the tire of a vehicle whereby the interaction of the feet of the platform and the tire provide a stable device.

It is a further object of the present invention to provide a load supporting a platform including an elevated horizontal member supported by a vertical framework and including rearwardly extending, outwardly and downwardly flared feet for interaction with the lower half of the vehicle tier providing great resistance to any downward or lateral movement of the platform. The platform also serves as a wheel chock preventing rolling motion of the vehicle.

It is yet another object of the invention to provide a step stool type device for assisting in working upon a vehicle wherein the steps, when in operation extend laterally outwardly from the outside of the vehicle tire and a step stool includes rearwardly extending feet which are wedged beneath the vehicle tire resisting lateral or downward movement of the step stool.

Yet another object of the present invention is to provide a platform for supporting a load wherein the platform may be quickly and easily placed into a position of interaction with a vehicle tire resisting any downward or lateral force on the platform and yet wherein the platform is collapsible for easy transport and storage.

Still another object of the present invention is to provide a stable working platform for utilization in conjunction with an automobile wheel wherein the elements are telescopically interconnected enabling a complete breakdown for shipment and storage.

Still another object of the present invention is to provide a steel platform wherein, when used in conjunction with an extension bar and a piece of plank can be used to provide a platform extending across the entire front of the vehicle.

BRIEF DESCRIPTION OF THE DRAWINGS

FIG. 1 is an isometric illustration of the inventive two-step stable stool in conjunction with the vehicle wheel.

FIG. 2 is a top plan view of the structure of FIG. 1.

FIG. 3 is a side elevational view of the structure of FIG. 1.

FIG. 4 is an isometric view of a one-step alternate embodiment of the inventive stable platform.

BEST MODE FOR CARRYING OUT THE INVENTION

Figures 5, 6:
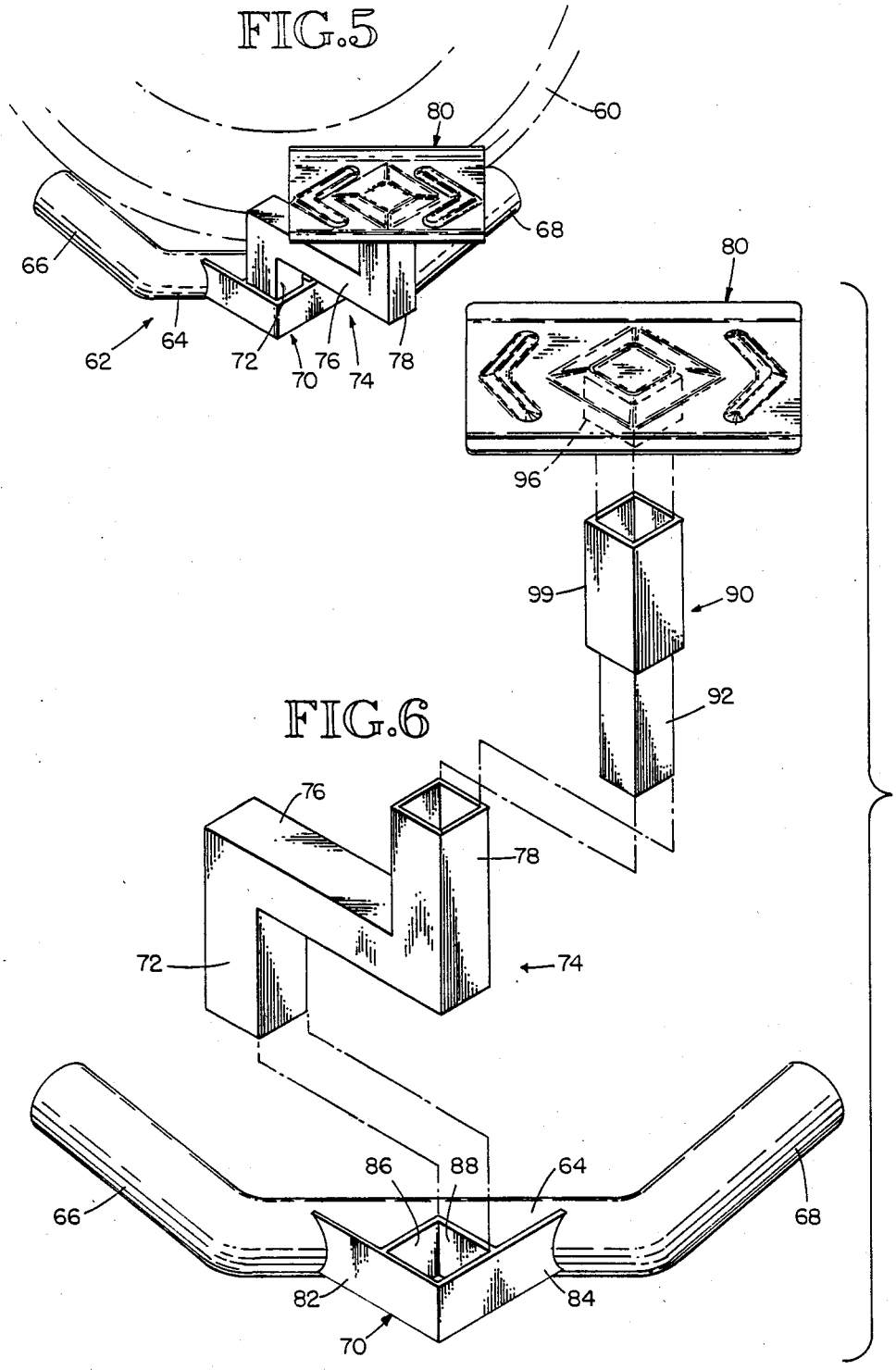
FIG. 5 is a isometric view of a second embodiment of the present invention.
FIG. 6 is an exploded view of a second embodiment illustrating how the various elements can be telescopically interconnected.

As seen in FIG. 1, the present invention includes a two-step platform and generally designated as 2 which achieves its stabilization by an interaction with a vehicle tire 4. As seen in this view, the present invention includes a pair of horizontal steps 4, 6 supported by a rear rectangular frame having vertical members 8, 10 and a horizontal member 12 at the lower end of the parallel members 8, 10. Extending downwardly from the front of the upper platform 6 are a pair of vertical structural elements 14, 16 which interconnect the front of platform 6 in the rear of platform 4.

A pair of angular support elements 18, 20 interconnect the front of platform 4 with the bottom portion of parallel frame members 8 and 10. Extending rearwardly from a position slightly upwardly from the bottom of frame members 8, 10 and flared both outwardly and downwardly are a pair of feet 22, 24 which are wedged beneath the bottom of the tire 4 resisting any torque generated by downward or sideward movement upon the platform 4 or 6.

Referring now to FIG. 2, the interrelationship of the device with the vehicle tire itself may more easily be seen. It is to be understood that feet 24, 26 will, because of their configuration, interact with vehicle tires of a different size. The proximity of the platform to the side of the tire will to a certain extent depend upon the size of the tire in relationship to the flare of the feet 24, 26.

Reference is now had to FIG. 3 wherein identical identifying numbers are used and the structural integrity is obvious.

Reference is now had to FIG. 4 wherein a single platform collapsing embodiment of the present invention is shown. As seen in this view, the single platform 30 is generally horizontal but is hingedly secured as at 32 to a pair of vertical frame members 34, 36 and is supported in its working condition by a pair of collapsible support members 38, 40 which fold about themselves allowing the platform 30 to be collapsed to a position adjacent the sides 34, 36. The bottom portion of the frame members 34, 36 is joined by a horizontal member 42. The rearwardly extending feet member 44, 46 are pivotally secured as at 48 to the vertical members 34, 36 by a means whereby they may be collapsed upwardly to parallel 34, 36 but are prevented from moving in the reverse direction.

Attention is now directed to FIG. 5 wherein the vehicle wheel is indicated as 60 and the second embodiment of the present invention includes a base member 62 having a central stabilizing and spacing section 64 separating a pair of legs 66, 68 which extend from the same side of a base member 62 and are divergent, forming a truncated V. Secured to the backside of the base member i.e. opposite the direction of legs is a horizontally disposed vertically open receptacle, described in greater detail hereinafter but including a rectangular exterior frame member 70. Frame member 70 telescopically receives the lower end 72 of stair step configured extension element 74 which is rectangular in cross section and includes, when in use, a horizontal portion 76 linking the vertical lower portion 72 and the upper vertical portion 78. Upper vertical portion 78 in turn supports a working platform 80 which is generally rectangular in configuration and includes on its lower side, as explained hereinafter a downwardly facing receptacle adapted to mate with the upper portion of the extension 74.

As seen in FIG. 6, wherein the second embodiment is shown in an exploded condition, the various elements, which are denoted with numbers identical with those used in FIG. 5, are designed to be telescopically connected or disconnected permitting collapse for storage. As more readily seen in FIG. 6, the rectangular framework 70 on the base member 64 includes, in addition to the two outside elements 82, 84, a pair of inner walls 86, 88 forming a rectangular vertical receptacle to receive the lower vertical end 72 of extension piece 74.

Likewise shown in FIG. 6 is a further extension member 90 having lower member, rectangular in cross-section, 92 to be received in the upper end of the vertical element 78 of extension 74 and a upper rectangular element 94 to interact with the receptacle 96 shown in phantom on the bottom of the platform 80. Likewise to be seen in this view is the fact that platform 80 will include some method of stiffening and providing traction such as creases or the like.

Figure 7:
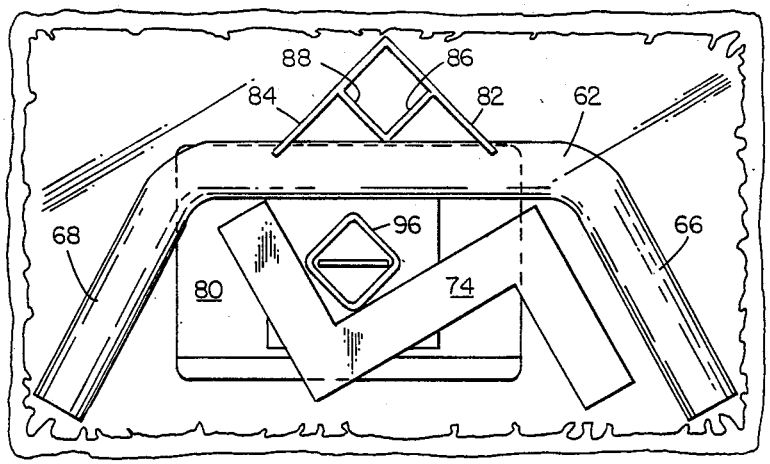
FIG. 7 is a plan view illustrating the interrelationship of the elements of the second embodiment when disassembled for storage or shipment.

FIG. 7 depicts the embodiment of FIGS. 5 and 6 in the collapsed condition in a suitable container for storage or shipping. It is to be noted that the various elements nest together to form a compact package, greatly reducing the cost of shipment and/or the space necessary for storage for the device when not in use.

Figure 8:
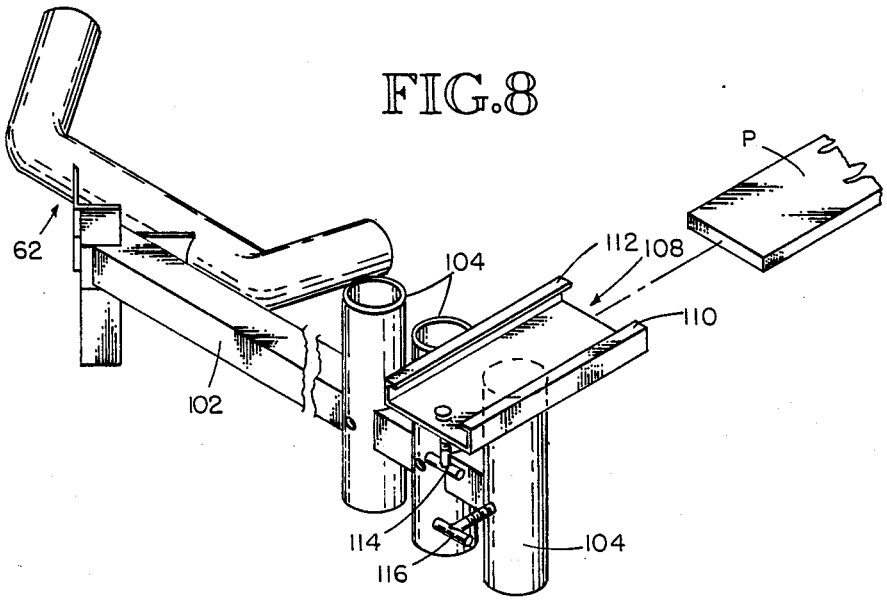
FIG. 8 is a view of the present invention when used in conjunction with an extension bar enabling the user to place a stable platform across the entire front of the vehicle, it is to be noted that the invention will be used in opposing pairs for this utilization.

Reference is had to FIG. 8 wherein an alternate utilization of the base stabilizing member is depicted. A vertical element 100, rectangular in cross-section, is mated with the rectangular opening 70 of the base member 62 which is placed beneath a wheel of the vehicle when in use. Secured to rectangular post 100 is a bar 102 including a plurality of vertical tube members 104 to selectively receive a vertical post 106. Post 106 includes at its upper end, a platform member 108 having upwardly and inwardly extending flanged members 112 to receive a plank or the like. The plank is secured in position by means of a threaded clamp member 114 and the vertical post is held in position by means of horizontal clamp member 116. In use one, of each of the extension members would be placed under the wheel of the vehicle and the bar placed parallel to the side of the vehicle. The two elements would be cross linked by a piece of lumber or the like extending across the front or the back of the vehicle providing a stable platform. The utilization of the vertical tube members 104 allows the device to be selectively adjusted to fit the varying distance from the wheel to the front of the vehicle. It is to be understood that any one of the number of adjusting means could equally as well be used.

Thus as can be seen, the present invention discloses a simple structural device which is capable of rigorous use without the danger of tipping from downward or sideward forces. The platform, when in place, likewise prevents any rolling motion of the wheels of the vehicle.

I claim:

1. A stool for use when working upon the engine of a vehicle or the like, said stool receiving its stability from interaction with the tire of the vehicle, said stool comprising:

a substantially rectangular vertical framework wherein the uppermost framework element is horizontal and of greater depth than the remainder of the framework and serves a rigid step extending to one side of the framework, a pair of feet, one mounted to each vertical element of the framework, adjacent to but spaced from the end opposite from the step and extending in a direction opposite the step, said feet angled outwardly and downwardly whereby when the step is placed adjacent the tire of the vehicle with the feet straddling said tire weight or movement on the step interacts immediately and directly against the tire.

2. A stool as in claim 1, wherein the step is collapsible.

3. A stool as in claim 1, wherein a second step is provided horizontally and vertically offset from the first step.

4. A stool as in claim 1, wherein the step potion is fabricated of an open mesh material.

5. A platform for use in conjunction with a vehicle tire comprising:

a vertical, substantially rectangular framework, platform means pivotally connected to and extending outwardly at substantially right angles to the framework on one side thereof, support means in the form of legs pivotally secured to the framework and extending outwardly thereof in a direction opposite the platform at a point adjacent to the bottom of the frame work whereby the legs are designed to be wedged beneath the vehicle tire, supporting the platform in a stable position.

6. A platform as in claim 5 and further including an intermediate platform.

7. A support for use in conjunction with a motor vehicle wherein the wheel of the vehicle provides the necessary stabilization, said support comprising:

a base member including a pair of opposing leg members extending divergently and outwardly from the same side of the base element whereby the leg members may be wedged beneath the wheel of the vehicle, a vertical extension releasable secured to the base member and extending upwardly therefrom, and a platform member removably secured to the top of the extension to provide a stable working platform.

8. A support as in claim 7 wherein the base member, the vertical extension and, the platform are telescopically interconnected.

9. A support as in claim 7 wherein the vertical extension includes a horizontal element resulting in the platform member being horizontally spaced from the base member.

* * * * *